US010508840B2

(12) United States Patent
Barban et al.

(10) Patent No.: US 10,508,840 B2
(45) Date of Patent: Dec. 17, 2019

(54) DEVICE THAT CAN BE USED WITH A REFRIGERANT FLUID FOR INCREASING THE THERMODYNAMIC EFFICIENCY

(71) Applicant: DYNAES, Berd Huis (FR)

(72) Inventors: Frédéric Barban, Paris (FR); Gilles Castelain, Saint Cyr la Rosiere (FR); Bruno Deboux, Saint Cloud (FR); Pascal Kalinowski, Villiers sous Mortagne (FR); Joëlle Rizk, Paris (FR); Jimmy Moro-Perez, Saint Jean de la Forêt (FR)

(73) Assignee: DYNAES, Berd Huis (FR)

( * ) Notice: Subject to any disclaimer, the term of this patent is extended or adjusted under 35 U.S.C. 154(b) by 182 days.

(21) Appl. No.: 15/038,189

(22) PCT Filed: Nov. 21, 2014

(86) PCT No.: PCT/FR2014/052983
§ 371 (c)(1),
(2) Date: May 20, 2016

(87) PCT Pub. No.: WO2015/075390
PCT Pub. Date: May 28, 2015

(65) Prior Publication Data

US 2016/0290686 A1 Oct. 6, 2016

(30) Foreign Application Priority Data

Nov. 22, 2013 (FR) ..... 13 61499

(51) Int. Cl.
*F25B 13/00* (2006.01)
*F25B 31/00* (2006.01)
(Continued)

(52) U.S. Cl.
CPC ..... *F25B 31/004* (2013.01); *F25B 9/004* (2013.01); *F25B 13/00* (2013.01); *F25B 45/00* (2013.01); *F25B 2500/16* (2013.01)

(58) Field of Classification Search
CPC .... F25B 13/00; F25B 2500/16; F25B 31/004; F25B 9/006
(Continued)

(56) References Cited

U.S. PATENT DOCUMENTS 4,214,453 A * 7/1980 Barrow ..... F25B 5/00 62/118
5,502,970 A * 4/1996 Rajendran ..... F25B 41/062 62/115
(Continued)

FOREIGN PATENT DOCUMENTS

FR 2 860 001 A1 3/2005
GB 2 286 037 A 8/1995
(Continued)

OTHER PUBLICATIONS

International Search Report issued in PCT/FR2014/052983 dated Mar. 5, 2015 (3 pages).
(Continued)

*Primary Examiner* — Filip Zec
(74) *Attorney, Agent, or Firm* — Osha Liang LLP

(57) ABSTRACT

A heat pump includes a closed circuit to contain a refrigerant fluid and a lubricant that is miscible with the refrigerant fluid. The closed circuit includes a fluid compressor and a fluid return circuit for returning fluid to the compressor. The compressor extends in the closed circuit between a fluid inlet and a fluid outlet. The return circuit extends in the closed circuit, complementarily to the compressor, between the fluid outlet and the fluid inlet. The return circuit includes a condenser, an expander and an evaporator. The return circuit
(Continued)

also includes a first line extending between the fluid outlet and the condenser, a second line extending between the condenser and the expander, a third line extending between the expander and the evaporator, and a fourth line extending between the evaporator and the fluid inlet.

17 Claims, 1 Drawing Sheet

(51) Int. Cl.
*F25B 9/00* (2006.01)
*F25B 45/00* (2006.01)

(58) Field of Classification Search
USPC ..... 62/509, 513
See application file for complete search history.

(56) References Cited

U.S. PATENT DOCUMENTS

| | | | | |
|---|---|---|---|---|
| 6,189,322 | B1 | 2/2001 | Ishihara et al. | |
| 2009/0126398 | A1* | 5/2009 | Okamoto | F25B 9/06 62/498 |
| 2010/0190124 | A1* | 7/2010 | Castelain | F24J 3/00 432/227 |

FOREIGN PATENT DOCUMENTS

| | | | |
|---|---|---|---|
| JP | S59-097475 | A | 6/1984 |
| JP | 2013-503945 | A | 2/2013 |
| WO | 2009/004124 | A1 | 1/2009 |
| WO | 2009/053726 | A2 | 4/2009 |
| WO | 2013/164439 | A1 | 11/2013 |

OTHER PUBLICATIONS

Written Opinion of the International Searching Authority issued in PCT/FR2014/052983 dated Mar. 5, 2015 (5 pages).
Notification of Reasons for Refusal issued in corresponding Japanese Application No. 2016-554920, dated Jan. 9, 2018 (9 pages).

* cited by examiner

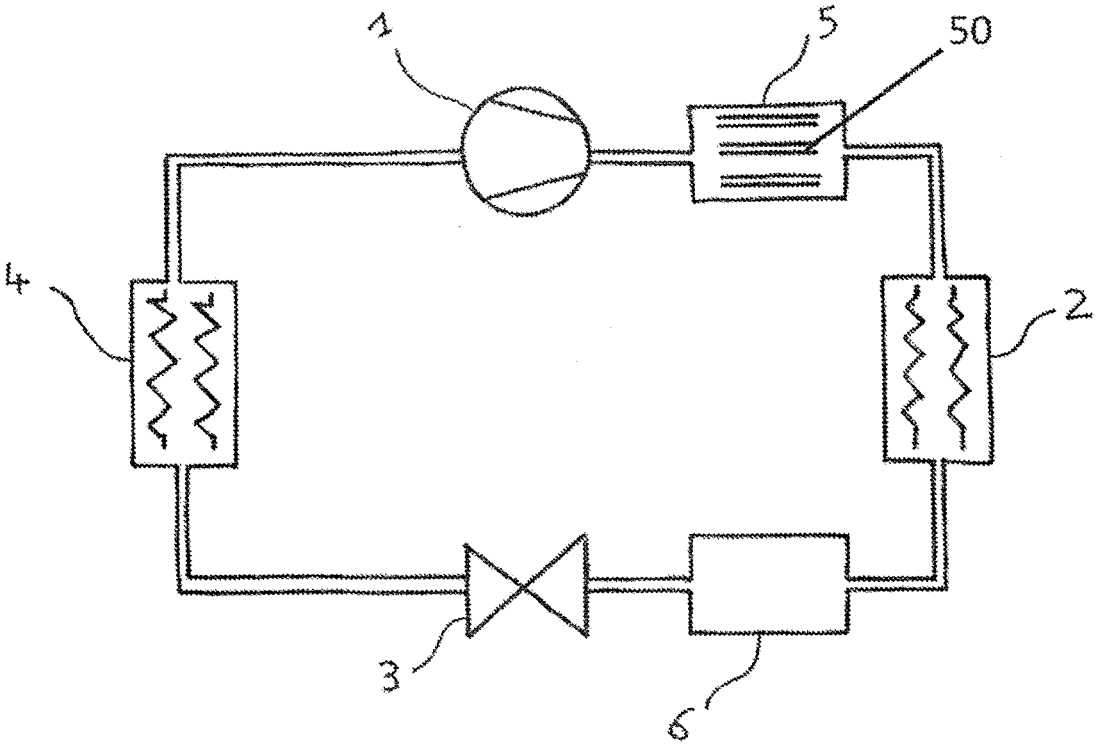
1
5
50
4
2
3
6

DEVICE THAT CAN BE USED WITH A REFRIGERANT FLUID FOR INCREASING THE THERMODYNAMIC EFFICIENCY

BACKGROUND

The invention relates to a heat pump, and in particular to improving the thermodynamic efficiency of a heat pump.

The prior art knows, from international application WO 2009/004124, a prior device for producing heat, in a thermodynamic system, by circulation of a pressurized fluid through a plurality of pipes in a widening of a line of a heat pump in which the fluid is in gaseous form, between an exchanger and a compressor.

Since this prior device produces heat, it remains difficult for the prior art to adapt it to the creation of a heat pump that can be used as a boiler in winter in a dwelling, or of a reversible heat pump, that can be used as a boiler in winter and as an air conditioning unit in summer. Such a pump creating a transfer of heat rather than a production of heat.

Documents WO 2013/164439, U.S. Pat. No. 6,189,322 and FR 2860001 describe other devices from the prior art.

One or more embodiments of the invention may overcome the drawbacks of the prior art.

SUMMARY

One aspect of the invention is a heat pump comprising a closed circuit intended to contain a refrigerant fluid and a lubricant that is miscible with the refrigerant fluid, the closed circuit comprising a fluid compressor and a return circuit for returning fluid to the compressor, the compressor extending in the closed circuit between a fluid inlet and a fluid outlet, the return circuit extending in the closed circuit, complementarily to the compressor, between the fluid outlet and the fluid inlet, the return circuit comprising a condenser, an expander and an evaporator, said return circuit comprising a first line extending between the fluid outlet and the condenser, a second line extending between the condenser and the expander, a third line extending between the expander and the evaporator, and a fourth line extending between the evaporator and the fluid inlet, said closed circuit comprising a first widening of a line of the return circuit, in series in the circuit, containing pipes in parallel in the circuit, and a second widening of a line of the return circuit, in series in the circuit.

In some embodiments:

- the return circuit comprises a first set of lines, consisting of the first line and of the fourth line, comprising said first widening, and a second set of lines, consisting of the second line and of the third line, comprising said second widening;
- the first widening is positioned on the first line;
- the second widening is positioned on the second line;
- the refrigerant fluid is a fluid from the Freon family;
- the fluid from the Freon family is a mixture comprising an R32 Freon, an R125 Freon and an R134a Freon;
- the mixture is an R407C Freon;
- the mixture is an R407A Freon;
- the lubricant is a synthetic oil;
- the synthetic oil is a polyolester oil;
- the polyolester oil is an oil of ISO VG 32 class;
- the polyolester oil of ISO VG 32 class has the trade name Emkarate® RL32-3 MAF;
- the first widening is positioned vertically;
- the first widening is positioned vertically and with ascending fluid.

One or more embodiments of the invention also relates to a use of a heat pump above, comprising the following steps:

- introducing the lubricant into the closed circuit;
- filling the closed circuit with the refrigerant fluid;
- circulating the refrigerant fluid in the closed circuit, by means of the compressor, for the heating or air conditioning of an enclosure with energy saving.

In one variant, said refrigerant fluid is ascending in the first widening.

BRIEF DESCRIPTION OF DRAWINGS

Certain embodiments of the invention will be described with reference to the accompanying drawings. However, the accompanying drawings illustrate only certain aspects or implementations of the invention by way of example and are not meant to limit the scope of the claims.

These features and others of the present invention will become more clearly apparent in the following detailed description made in reference to the appended drawing, given without implied limitation, and in which FIG. 1 schematically represents a heat pump in accordance with embodiments of the invention.

DETAILED DESCRIPTION

For the purposes of describing embodiments of the invention, the following designations are used:

"Heat pump": a thermodynamic device for transferring heat from a source cooled by the heat pump by withdrawing heat from this source (or heat sink), in contact with an evaporator of the pump, to a source heated by the pump by evacuation of heat to this source (or heat source) in contact with a condenser of the pump. A pump also comprises a compressor powered by an external energy source that makes possible the transfer of heat from the heat sink to the heat source, in accordance with the second law of thermodynamics and comprises an expander for reducing the pressure imposed on the fluid, by the compressor. The condenser and the evaporator, which are the heat exchangers of the pump, are connected by two refrigerant fluid transport branches or lines, forming a closed circuit comprising, in series in the circuit, in one of the branches the compressor and, in series in the circuit, in the other branch, the expander. The closed fluidic circuit contains, in a leaktight manner, refrigerant fluid, made to flow in the circuit by the compressor and circulating in particular from the evaporator to the condenser, through the compressor, and circulating from the condenser to the evaporator, through the expander. The pump is adapted for withdrawing heat from the heat sink, by evaporation of this fluid in the evaporator, for transporting heat to the heat source from the evaporator to the condenser through the compressor, and giving up this heat to the heat source, by condensation of the fluid in the condenser.

"Reversible heat pump": a heat pump operating between a heat sink and a heat source in which a known additional system of fluidic valves makes it possible to move from a mode of heating the heat source, in contact with a first exchanger, by a heat sink, in contact with a second exchanger, to a mode of cooling the heat source, by reversing the direction of circulation of the fluid in the circuit, or by reversing the order of the exchangers in the circuit for the same direction of circulation of the fluid. A reversible heat pump requires a transfer of heat and not a creation.

"COP": a coefficient of performance Q/W characterizing the thermodynamic efficiency of a pump by an energy ratio between the energy Q, in thermal form transferred by the pump from the heat sink to the heat source and the energy W, in the form of work, usually electrical work, necessary for the operation of the pump. A high number characterizes an efficient pump. This number may be greater than one without contradicting the second law of thermodynamics.

"Freon": usual commercial name of chlorofluorocarbons or CFCs classified by various bodies such as in particular the "ASHRAE" (American Society of Heating, Refrigerating and Air-Conditioning Engineers, Inc.) according to a numbered list in which a Freon is identified by a number "abc", where a=(number of C)−1, b=(number of H)+1 and c=number of F. If a is equal to 0, it is omitted in the formula. Freons are referenced in the application either by their chemical formula or by the "Freon" name followed by a number abc of the classification, or by F followed by a number abc, or by R followed by abc.

In the application, the following will thus particularly be considered:

Freon 32 or R32 or F32 which is difluoromethane;

Freon 125 or R125 or F125 which is pentafluoroethane;

Freon 134a or F134a or R134a which is 1,1,1,2-tetrafluoroethane;

Freon R407C which is a mixture typically of 23% of R32, 25% of R125 and 52% of R134a (weight percentages), R407A (20%, 40%, 40%) and R407F (30%, 30%, 40%). All of the mixtures of R32, R125 and R134 being denoted by "R407 Freon family", a subfamily of the family consisting of all the Freons among the set of refrigerant fluids or coolants. R407A is in particular less rich in R134a than R407C.

"Synthetic oils" or "POE oils": synthetic polyolester oils used for the purposes of lubrication of the compressor of a heat pump, in particular for heating or cooling dwellings, using R32, R125 and R134a in the composition of the refrigerant fluid used by this pump. These oils are perfectly miscible, at the evaporator and condensation temperatures of the pump, with R32, R125 and R134a, in order to allow a return of oil mixed with these Freons in the liquid phase, from the condenser to the evaporator of the pump. The Freons R32, R125 and R134a in the gas phase are also soluble in these oils, so as to ensure a return in the gas phase of the Freon from the evaporator to the compressor of the pump and to promote as best possible the transport of the oil, especially in the form of a Freon-loaded oil mist between the compressor and the heat exchangers of the pump, that is to say the assembly consisting of the two elements that are the evaporator and the condenser of the pump.

"Positioned vertically": in a heat pump in normal operation denotes, for a widening of a line or pipes of a line, an orientation that defines a flow direction parallel or antiparallel to the field of gravity. This notion also denotes a line or pipes in which the two-phase flow regimes in vertical pipes apply preferentially to the horizontal two-phase flow regimes, due to its orientation. More generally, this notion also denotes a line or pipes having a slope for a flow and which is not therefore horizontal. The notion is not therefore limited, within the meaning of the invention, to a strict parallelism to the field of gravity of pipes or of a widening of a line.

The closed circuit comprises the fluid compressor 1 and a return circuit for returning fluid to the compressor. The compressor extends in the closed circuit between the fluid inlet and the fluid outlet, the return circuit extending in the closed circuit, complementarily to the compressor, between the fluid outlet and the fluid inlet. The return circuit comprises the condenser 2, the expander 3 and the evaporator 4. Said return circuit thus comprises a first line extending between the fluid outlet and the condenser, a second line extending between the condenser and the expander, a third line extending between the expander and the evaporator, and a fourth line extending between the evaporator and the fluid inlet.

According to embodiments of the invention, said closed circuit comprises a first widening 5 of a line of the return circuit, in series in the circuit, containing pipes 50 in parallel in the circuit, and a second widening 6 of a line of the return circuit, in series in the circuit.

Embodiments of the invention are described below by way of example with reference to a FIG. 1. FIG. 1 shows a representation of a heat pump provided with two line widenings: a first line widening 5, with pipes 50, positioned between a fluid outlet of the compressor 1 of the pump and a condenser 2 of the pump and a second widening 6 without pipes positioned between the condenser 2 and the expander 3 of the pump. The pump also has an evaporator 4.

Use may for example be made of a heat pump for heating of AIRWELL® brand and having a nominal power of 12 kW.

Embodiments of the invention may also be carried out with an AIRMEC® reference heat pump, of ANF 50 model with a power of 15 kW or ANF 100 model with a power equal to 35 kW. The invention is not therefore limited to one manufacturer or to one particular model.

The pump may use a set of copper lines having an internal diameter of fourteen millimeters (14 mm) forming a closed circuit that is leaktight with respect to gases and to liquids, the closed circuit being immersed in the atmosphere.

Inserted into this circuit is a compressor 1 of reference ZB38KCE having a fluid inlet and a fluid outlet. By travelling through the closed circuit outside of the compressor, from the fluid outlet or discharge of the compressor to the fluid inlet of the compressor or intake, encountered in series in the closed circuit are a first widening 5 with pipes 50, a condenser 2, a second widening 6 without pipes, an expander 3 and an evaporator 4.

The first widening with pipes consists, over a first 14 mm line, in a local increase in the internal diameter of the line or first widening. This first widening 5 contains internal pipes 50, for example seven tubes having an internal diameter of 5 mm for an external diameter of 8.5 mm, surrounded by the first widening of the line. The internal diameter of the widening is suitable for being able to encircle the tubes and the thickness of the widening is suitable for withstanding the maximum pressure specified for the fluid in this part of the pump.

The internal diameter of the widening is, for 7 tubes arranged compactly, equal to 3 times the external diameter of a tube, i.e. around 25.5 mm. For a larger number of tubes, this internal diameter of the widening may be deduced as being the external diameter of the tubes, held in a compact manner.

A sum of the internal cross sections of the 5 mm tubes will be chosen that is equal to the internal cross section of the 14 mm line for a 15 kW pump and that is equal to double the internal cross section for a 35 kW pump.

Should a line of larger internal cross section be provided with a widening, the same ratio between the diameter of the pipes and the diameter of the line as that of this first embodiment will be chosen, i.e. here a ratio equal to 14 mm/5 mm or 2.8.

The length of the pipes of the first widening will be taken as equal to around 22 cm for a pump of AERMEC® origin and 13 cm for a pump of AIRWELL® origin.

The condenser, a known element, is encountered in the circuit after the first widening.

The second widening is designed to operate in the liquid phase for the refrigerant fluid and the oil, it is for example identical to the first widening but it may or may not comprise pipes, these not having been recognized as essential for obtaining the effect of embodiments of the invention with the second widening present in the circuit in addition to the first widening. The second widening is followed, downstream, by the expander. The expander is a known element, operating in mainly liquid phase, at its inlet, and designed to produce a two-phase mixture of gas and liquid in the normal operation of the heat pump of embodiments of the invention.

The expander is followed, downstream, by the evaporator, a known element.

In a use in heating mode, the pump is bought into contact, at the evaporator, with the atmosphere surrounding an enclosure to be heated and at the condenser with a circuit for heating the enclosure.

In a use in cooling mode, the pump is bought into contact at the evaporator with an enclosure to be cooled and at the condenser with the atmosphere surrounding the enclosure.

Known fluidic valves may make it possible to pass, via an action of the user, from a heating mode to a cooling mode, should the pump according to embodiments of the invention be reversible.

The Freon chosen for all the pumps is an R407C or R407A Freon and the oil is an EMKARATE® RL32-3 MAF oil, miscible with the chosen Freon at all the operating temperatures.

Generally, for the implementation of embodiments of the invention, use will be made of a refrigerant fluid or coolant and an oil that are miscible with one another.

The refrigerant fluid family formed by the Freons of R407 designation and the oils miscible with the Freons of this family in particular constitute a set of fluids that can be used with embodiments of the invention.

Independently of the explanation of the physical phenomenon behind embodiments of the invention applied to a commercial pump modified by the first widening with pipes and the second widening and operating with a mixture of EMKARATE® RL32-3 MAF oil and a mixture of R32, R125 and R134a, certain indications below which have been observed by the applicant during numerous experiments may be used by a person skilled in the art to reproduce, adapt or extend embodiments of the invention to other mixtures of refrigerant fluids and oil and to design, by virtue of the teaching thereof, a heat pump having improved thermodynamic efficiency.

One or more embodiments of the invention include the ability to transport the oil of a heat pump, in the form of an emulsion of drops of oil, suitable for increasing the heat exchanges in the condenser and in the evaporator of the pump. The first and second widening therefore tend to regenerate or maintain this emulsion in its form suitable for improving the operation of the heat exchangers (condenser and evaporator) of the pump.

The presence of drops, taken as being synonymous with bubbles (containing gas) in a gas transport medium, or of drops taken as being synonymous with "antibubbles" (bubbles of oil containing gas) in a liquid transport medium, is considered as providing nucleation sites for the condensation of the transport medium or the evaporation of this medium, favoring the heat exchanges, during its phase changes in the exchangers of the pump.

This emulsion is estimated, in the gas phase, to be a mist of droplets forming a "monodisperse" emulsion of oil in a gas phase (i.e. having droplets for which the values of the diameters are strongly centered on a common value), having a lifetime sufficient to reach the condenser and to improve the heat exchanges therein. Embodiments of the invention therefore uses a first means for forming a mist of oil between the compressor and the condenser. One particular means is thus a means for imposing a negative pressure on oil drops that have absorbed a transporting refrigerant fluid gas due to the solubility of the gas in the oil and to give rise to the appearance of gas bubbles in the drops that are capable of bursting into finer droplets.

This emulsion is estimated, in the liquid phase, to be a mixture of droplets of oil forming a "monodisperse" emulsion of oil in a liquid phase, having a lifetime sufficient to reach the expander, to pass through it, to reach the evaporator and to improve the heat exchanges therein, in order to finally return to the compressor regularly over time and in the form of a mist of oil having a uniform diameter of oil drops and to improve the isentropic efficiency thereof by an improved lubrication, in comparison with a commercial pump.

Embodiments of the invention thus uses, in order to improve the COP of a heat pump, a first means for forming a mist of oil between the compressor and the condenser and a second means for forming a dispersion of drops of oil in the liquid phase between the condenser and the compressor, it being possible for these drops to burst into droplets or into bubbles on passing through the expander and to reach the evaporator.

The elements of embodiments of the invention that are the first widening with pipes and the second widening may thus be adapted by a person skilled in the art in order to achieve this objective.

Only the widening with pipes being previously known in the gas phase with any Freon and as secondary heat source.

The improvement in the thermodynamic efficiency or in the COP of the assembly of a heat pump using one or two widenings, one particular refrigerant fluid and an oil miscible with the refrigerant fluid, was not therefore expected, in the prior art. The effect obtained makes it possible to envisage heating or cooling uses with a pump provided with at least one widening.

This improvement is obtained without an increase in temperature at the boundaries of the first widening alone which does not therefore operate as a secondary heat source.

It was possible with embodiments of the invention to observe, with R407C and with a single widening with pipes, an increase in the COP of 27% at +7° C., on an AIRWELL® pump.

With R407A, an increase in COP of 21% was obtained at the same temperature.

Comparable results, as percentages of increase in COP, were obtained for an AERMEC® ANF 50 or ANF 100 pump.

However, with a single widening, this result of improvement in the COP is degraded below the temperature of +7° C. when a single widening is used. It becomes especially unusable in practice at 0° C., the percentage of increase in COP becoming less than 10%.

In order to obtain an increase in COP over an extended range from −7° C. to +7° C., the second widening is therefore added to the first widening.

In this case, for an AIRWELL® brand machine, the features of increase in thermal power observed were the following with the two widenings, also referred to as "kit" of embodiments of the invention:

A) Nominal 12 kW AIRWELL® Machine—R407C and POE Oil

A.1) Temperature 7° C.: manufacturer power 12.72 kW; power with kit 16.1; increase in COP 27%

A.2) Temperature 0° C.: manufacturer power 10.65 kW; power with kit 14.24; increase in COP 34%

A.3) Temperature −7° C.: manufacturer power 8.5 kW; power with kit 11.67; increase in COP 37%

B) Nominal 12 kW AIRWELL® Machine—R407A and POE Oil

B.1) Temperature 7° C.: manufacturer power 12.67 kW; power with kit 15.28; increase in COP 21%

B.2) Temperature 0° C.: manufacturer power 11.09 kW; power with kit 13.65; increase in COP 23%

B.3) Temperature −7° C.: manufacturer power 9.03 kW; power with kit 10.32; increase in COP 14%

Comparable results, as percentages of increase in COP, were obtained for an AERMEC® ANF 50 pump or ANF 100 pump.

It is therefore observed that the two widenings make it possible to ensure an increase in COP over an entire temperature range and especially the coldest temperatures. It is also observed that in one embodiment of the invention, use will be made of R407C and an oil miscible therewith such as a polyolester or POE oil.

These results therefore demonstrate the usefulness of embodiments of the invention in terms of energy saving in the use of a heat pump.

The elements of this first mode are set out below in a more detailed manner.

The first widening is composed over its length, and travelling along the closed circuit from the fluid outlet of the compressor to the first line joining the fluid outlet of the compressor to the condenser, of a first zone of increase in internal diameter of the line, of a second zone of constant internal diameter of the line and of a third zone of decrease in internal diameter of the line.

In a known manner, the change in diameter of the first zone may be carried out by a first cone, the apex angle of which makes it possible, for the normal fluidic operating conditions of the pump, to cause a separation of the flow lines of the fluid travelling through the pump.

In a known manner, the change in diameter of the third zone may be carried out by a second cone, the apex angle of which makes it possible, for the normal fluidic operating conditions of the pump, not to cause a separation of the flow lines of the fluid travelling through the pump.

In any case, the second zone of the first widening will advantageously be positioned vertically, when the refrigerant fluid will be a mixture of Freons and oil. This zone will thus have a chimney arrangement or a chimney or vertical duct function for the first widening, which operates, normally, with a gaseous refrigerant fluid and drops of oil.

This arrangement will enable a transfer of heat to the condenser, and not a production of heat that does not reach the condenser, by increasing the lifetime of the emulsion of Freon and drops of oil after the fluid has passed through the first widening and by enabling them to reach the condenser despite the coalescence.

Such a vertical structure enables, for a Freon or a mixture of Freons that is/are soluble in an oil present as drops transported with the gas, numerous simultaneous effects that result in creating or in regenerating an emulsion of gas and oil that is stable over time, such as that produced conventionally by the compressor, at its discharge outlet, and in which the drops are usually "polydisperse" (i.e. considerably variable about a central value) in terms of diameter.

Mention may be made, among these effects, of:

- a Joule-Thomson expansion in the first cone makes it possible, for the portion of the gases soluble in the drops of oil, to form bubbles that burst into droplets that are smaller than the drops and that are well sized;
- a separation of the flow lines of the fluid giving rise to a dead volume in the first cone at which turbulences are created that split the drops which are transported thereto;
- a selection of the drops by the vertical tubes prohibiting or discouraging the circulation of the oil in film form to the condenser, by giving rise to waves along the tubes and by producing foam of droplets along these tubes from a film of oil on the walls of the tubes;
- a selection of the drops by the vertical tubes that acts as a collimator of the direction of the drops and of the mass thereof, by favoring the transport of the droplets rather than the drops, the mass of the drops favoring the trapping thereof along the tubes and the transformation thereof into foam of droplets in a manner known in two-phase fluid mechanics in vertical tubes;
- a tranquillization of the flow by the tubes and the second cone, enabling a transport of the droplets created by the vertical first widening without coalescence and with low pressure drops up to the condenser which follows the first widening in the circuit.

For a mixture of refrigerant gas and oil, a person skilled in the art will be able to modify the length of the tubes and the diameter thereof in order to obtain an oil splitting effect favorable to the increase in the thermodynamic efficiency of the pump, efficiency or COP measured by means known from the prior art.

In particular, a change in the circulating composition from the mixture initially introduced into the fluidic circuit could be an indication of operation of embodiments of the invention. For an initial mixture of R407C introduced, it will be possible to observe variations in the compositions of the mixture measured at the outlet of the compressor, over time as a function of the operating conditions: external temperature, temperature of the hydraulic circuit, adjustment of the expander. Since the differential solubility of the components of R407C in the oil is variable, a trapping of the oil in the tubes of the first widening could also explain this variation in circulating composition. However, such a variation which also changes the density of the circulating mixture cannot by itself explain an increase in the COP, an increase in the electrical power necessary for moving this heavier mixture having to be provided at the same time. The influence of the mutual solubility of the oil and of the Freons is therefore considered an indicator useful for the development of the vertical first widening for the multiple practical cases of a pump according to embodiments of the invention operating with R407C, R407A, standardized variants of the R407 family or a mixture of R32, R125 and R134a in non-standardized proportions.

It is not excluded for a particular Freon other than a mixture of R32, R125 and R134a to also be used according to embodiments of the invention as long as an increase in the thermal power of the condenser is observed on introducing a first widening into the fluidic circuit of a pump operating with this particular Freon.

More generally, as indicated above, a particular mixture of any (Freon or non-Freon) refrigerant fluid and an oil soluble with any of the gaseous refrigerant fluids and miscible with any of the liquid refrigerant fluids, at the operating temperatures of the closed circuit of a heat pump, a particular mixture which would make it possible to observe an increase in the thermal power of the condenser on introducing a first widening with vertical pipes between the compressor and the condenser of the heat pump operating with this particular mixture, would be in accordance with embodiments of the invention.

A person skilled in the art, in the presence of such an increase, could adjust the length and the diameter of the tubes or adjust the distance separating the first widening from the condenser, in the fluidic circuit, in order to optimize the increase in power observed in the condenser, for example by measuring the temperature of a hot water output from a heating circuit in thermal contact with the condenser. A person skilled in the art could also vary the verticality of the tubes by allowing an angle that gives the tubes a slope that enables the flow of the oil downward, while maintaining an effect on the thermal power of the condenser relative to a strict verticality.

For the pairs of refrigerant fluid and oil in accordance with embodiments of the invention and using a mixture of R32, R125 and R134a, the percentages improvement in COP, for R407C, R407A and R407F, are as follows:

| Ambient air | 407C Increase in COP | 407A Increase in COP | 407F Increase in COP |
|---|---|---|---|
| 7° C. | 27% | 21% | −3% |
| 0° C. | 34% | 23% | 12% |
| −7° C. | 37% | 14% | 3% |

For a general refrigerant fluid, mixture of oil in the form of drops of oil and of gas, such as Freons in the gas phase, passing through the first widening, this structure is designed to form a means of regularly splitting the drops of oil with the result of forming an emulsion of drops and of gas that is sufficiently stable, in terms of lifetime of the drops, to enable them to reach the condenser and form nucleation sites improving the heat exchanges in the condenser and the thermodynamic efficiency of the pump. For a foaming mixture of oil and of gas, the same general inventive idea of a means for forming an emulsion will be applied to the design of the first widening with pipes but instead of an emulsion of drops in one or more gases, the first widening will be designed in order to form an emulsion of bubbles in the gas or gases.

A mixed mode for which an emulsion of drops but also of bubbles of oil is formed by the first widening between the oil and the Freons present in the first line is not excluded as a function of the relative surface tension properties of the oil and of the Freons at the operating temperature and pressure of the fluid in the first line.

Embodiments of the invention were tested with mixtures of the Freons R32, R125 and R134a induced by an introduction of R407C and one particular EMKARATE® RL32-3 MAF oil into the circuit of a pump modified by the vertically positioned first widening and having the second widening.

Any refrigerant fluid and an oil soluble and miscible with this refrigerant fluid, producing an increase in the thermal power of the condenser in the same circuit, would be in accordance with embodiments of the invention, this increase being a criterion of embodiments of the invention. The result of embodiments of the invention is however obtained when this increase in power is obtained at the same time as an increase in COP. A person skilled in the art will therefore be able, among the pairs of refrigerant fluid and oil that give rise to an increase in the thermal power, to determine, by introducing the second widening, the pairs that give rise to an increase in the COP.

In particular, for the Freons, a synthetic polyolester or "POE" oil, a family comprising oils known for being miscible with the Freons in the liquid phase and in which the Freons in the gas phase are soluble, would be in accordance with embodiments of the invention with the Freons.

In other embodiments of the invention, the operation of a commercial AERMEC® ANF 50 heat pump is modified and is explained in detail in terms of pressure and temperature in the pump.

A compressor (referenced ZB38KCE) is used. This compressor is of "Scroll" technology and it discharges a mixture of an EMKARATE® RL32-3 MAF polyolester oil, gaseous R32, gaseous R125 and gaseous R134a at a temperature of T=87° C. and a pressure of P=18 bar.

The oil is considered to be a liquid form throughout the closed circuit at the temperatures and pressures mentioned.

The first widening is vertical and has ascending fluid, it experiences P=18 bar and T=84° C. at the inlet and P=18 bar and T=84° C. at the outlet. The mixture of R32, R125 and R134a is gaseous at the outlet. There is therefore, in normal operation in this embodiment, no increase in temperature at the outlet of the first widening relative to its inlet, and this widening does not therefore operate as a heat source.

The condenser experiences P=18 bar and T=84° C. at the inlet and at the outlet P=18 bar and T=45° C. The mixture of R32, R125 and R134a is liquid at the outlet.

The second widening is descending vertical and experiences P=18 bar and T=45° C. at the inlet and P=18 bar and T=45° C. at the outlet. The mixture of R32, R125 and R134a is liquid at the outlet, with liquid-gas two-phase periods where bubbles appear. There is therefore, in normal operation in this embodiment, no increase in temperature at the outlet of the second widening relative to its inlet, and this widening does not therefore operate as a heat source.

The expander experiences P=7 bar, T=13° C. at the outlet. The mixture of R32, R125 and R134a is a liquid-gas two-phase mixture at the outlet.

The evaporator experiences P=7 bar and T=13° C. at the inlet. The mixture of R32, R125 and R134a is gaseous at the outlet.

The compressor sucks up a mixture of EMKARATE® RL32-3 MAF oil, R32, R125 and R134 at P=4 bar and T=5° C.

In this configuration, the increases in COP are comparable to those of an AIRWELL® brand machine mentioned above for the first embodiment, over the temperature range extending from −7° C. to +7° C.

The invention is industrially applicable in the field of heat pumps and air-conditioning units.

Various modifications are accessible to a person skilled in the art without departing from the scope of the present invention as described in the appended claims.

While the invention has been described above with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

The invention claimed is:

1. A heat pump comprising:

a closed circuit intended to contain a refrigerant fluid and a lubricant that is miscible with the refrigerant fluid, the closed circuit comprising a fluid compressor and a return circuit for returning fluid to the compressor, the compressor extending in the closed circuit between a fluid inlet and a fluid outlet, the return circuit extending in the closed circuit, complementarily to the compressor, between the fluid outlet and the fluid inlet, the return circuit comprising a condenser, an expander and an evaporator, said return circuit comprising a first line extending between the fluid outlet and the condenser, a second line extending between the condenser and the expander, a third line extending between the expander and the evaporator, and a fourth line extending between the evaporator and the fluid inlet, wherein the closed circuit comprises a first widening of one of the lines of the return circuit, in series in the circuit, containing pipes in parallel in the circuit, and a second widening of one of the lines of the return circuit, in series in the circuit, wherein the first widening regenerates or maintains an emulsion of oil droplets by imposing a negative pressure on the oil droplets in both a liquid phase and a gas phase, wherein the second widening regenerates or maintains an emulsion of oil droplets by imposing a negative pressure on the oil droplets in a liquid phase, and wherein the emulsion of the oil droplets travel through the first widening, the condenser, the second widening, the expander, the evaporator, and to the fluid compressor.

2. The pump as claimed in claim 1, wherein the return circuit comprises a first set of lines, consisting of the first line and of the fourth line, comprising said first widening, and a second set of lines, consisting of the second line and of the third line, comprising said second widening.

3. The pump as claimed in claim 2, wherein the first widening is positioned on the first line.

4. The pump as claimed in claim 2, wherein the second widening is positioned on the second line.

5. The pump as claimed in claim 3, wherein the refrigerant fluid is a fluid from the Freon family.

6. The pump as claimed in claim 5, wherein the fluid from the Freon family is a mixture comprising an R32 Freon, an R125 Freon and an R134a Freon.

7. The pump as claimed in claim 6, wherein the mixture is an R407C Freon.

8. The pump as claimed in claim 6, wherein the mixture is an R407A Freon.

9. The pump as claimed in claim 3, wherein the lubricant is a synthetic oil.

10. The pump as claimed in claim 9, wherein the synthetic oil is a polyolester oil.

11. The pump as claimed in claim 10, wherein said first widening is positioned vertically.

12. The pump as claimed in claim 11, wherein said first widening is positioned vertically and with ascending fluid.

13. The use of a heat pump as claimed in claim 12, comprising the following steps:

introducing the lubricant into the closed circuit;

filling the closed circuit with the refrigerant fluid;

circulating the refrigerant fluid in the closed circuit, by means of the compressor, for the heating or air conditioning of an enclosure with energy saving.

14. The use as claimed in claim 13, wherein said refrigerant fluid is ascending in said first widening.

15. The pump as claimed in claim 3, wherein the second widening is positioned on the second line.

16. The pump as claimed in claim 4, wherein the second widening is positioned on the second line.

17. The pump as claimed in claim 5, wherein the lubricant is a synthetic oil.

* * * * *